US007051456B2

(12) United States Patent
Swigart et al.

(10) Patent No.: US 7,051,456 B2
(45) Date of Patent: May 30, 2006

(54) ARTICLE OF FOOTWEAR INCORPORATING AN INFLATABLE CHAMBER

(75) Inventors: John F. Swigart, Portland, OR (US); K. Peter Hazenberg, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 10/628,567

(22) Filed: Jul. 29, 2003

(65) Prior Publication Data

US 2005/0022422 A1 Feb. 3, 2005

(51) Int. Cl.
*A43B 7/06* (2006.01)

(52) U.S. Cl. ..... 36/3 R; 36/29; 36/3 B; 36/35 R

(58) Field of Classification Search ..... 36/28, 36/29, 3 R, 3 B, 35 R, 35 B
See application file for complete search history.

(56) References Cited

U.S. PATENT DOCUMENTS

| | | | | |
|---|---|---|---|---|
| 4,183,156 | A | 1/1980 | Rudy | |
| 4,446,634 | A | 5/1984 | Johnson et al. | |
| 4,507,880 | A | 4/1985 | Ohashi | |
| 4,724,627 | A | 2/1988 | Sisco | |
| 4,835,883 | A | 6/1989 | Tetrault et al. | |
| 4,860,463 | A | 8/1989 | Pin | |
| 4,888,887 | A | 12/1989 | Solow | |
| 4,912,861 | A | 4/1990 | Huang | |
| 4,995,173 | A | 2/1991 | Spier | |
| 5,131,174 | A * | 7/1992 | Drew et al. | 36/35 B |
| 5,144,708 | A | 9/1992 | Pekar | |
| 5,193,246 | A | 3/1993 | Huang | |
| 5,335,382 | A | 8/1994 | Huang | |
| 5,353,459 | A | 10/1994 | Potter et al. | |
| 5,353,525 | A * | 10/1994 | Grim | 36/88 |
| 5,363,570 | A * | 11/1994 | Allen et al. | 36/28 |
| 5,406,661 | A * | 4/1995 | Pekar | 5/655.3 |
| 5,524,364 | A * | 6/1996 | Cole et al. | 36/29 |
| 5,558,395 | A | 9/1996 | Huang | |
| 5,564,143 | A | 10/1996 | Pekar et al. | |
| 5,625,964 | A * | 5/1997 | Lyden et al. | 36/29 |
| 5,669,161 | A | 9/1997 | Huang | |
| 5,704,137 | A * | 1/1998 | Dean et al. | 36/28 |
| 5,794,361 | A | 8/1998 | Sadler | |
| 5,826,349 | A | 10/1998 | Goss | |

(Continued)

FOREIGN PATENT DOCUMENTS

FR 2614510 * 11/1988

(Continued)

OTHER PUBLICATIONS

International Search Report in corresponding PCT case, application No. PCT/US2004/017434, mailed Nov. 8, 2004.

*Primary Examiner*—Marie Patterson
(74) *Attorney, Agent, or Firm*—Banner & Witcoff, Ltd.

(57) ABSTRACT

An article of footwear is disclosed that includes a fluid system having a pump chamber and an inflatable pressure chamber. The pressure chamber is configured to extend at least partially around the pump chamber to limit the pressure of a fluid within the pressure chamber. The relative elevation of the pump chamber and pressure chamber may be selected, for example, such that the pump chamber is within an elevation defined by the upper and lower surfaces of the pressure chamber. The fluid system may be substantially formed from a pair of polymer layers that are bonded together to form the pump chamber and the pressure chamber, and the fluid system includes valves located between the layers.

53 Claims, 9 Drawing Sheets

U.S. PATENT DOCUMENTS

| | | | | | |
|---|---|---|---|---|---|
| 5,830,553 | A | | 11/1998 | Huang | |
| 5,845,417 | A | | 12/1998 | Reed et al. | |
| 5,846,063 | A | * | 12/1998 | Lakic | 417/440 |
| 5,894,683 | A | * | 4/1999 | Lin | 36/35 B |
| 5,902,660 | A | | 5/1999 | Huang | |
| 5,930,918 | A | * | 8/1999 | Healy et al. | 36/29 |
| 5,937,462 | A | | 8/1999 | Huang | |
| 5,950,332 | A | | 9/1999 | Lain | |
| 5,976,451 | A | | 11/1999 | Skaja et al. | |
| 5,992,052 | A | | 11/1999 | Moretti | |
| 5,996,250 | A | | 12/1999 | Reed et al. | |
| 6,085,444 | A | | 7/2000 | Cho | |
| 6,128,837 | A | | 10/2000 | Huang | |
| 6,161,240 | A | | 12/2000 | Huang | |
| 6,192,606 | B1 | * | 2/2001 | Pavone | 36/29 |
| 6,247,248 | B1 | | 6/2001 | Clark | |
| 6,428,865 | B1 | | 8/2002 | Huang | |
| 6,457,262 | B1 | | 10/2002 | Swigart | |
| 6,460,197 | B1 | | 10/2002 | Huang | |
| 6,510,624 | B1 | * | 1/2003 | Lakic | 36/29 |
| 6,553,691 | B1 | | 4/2003 | Huang | |
| 2002/0035794 | A1 | | 3/2002 | Doyle | |
| 2002/0053146 | A1 | * | 5/2002 | Swigart | 36/29 |
| 2002/0194747 | A1 | | 12/2002 | Passke et al. | |
| 2003/0084593 | A1 | | 5/2003 | Lakic | |

FOREIGN PATENT DOCUMENTS

| | | | |
|---|---|---|---|
| FR | 2670369 | * | 12/1990 |
| FR | 2 607 369 | | 6/1992 |
| JP | 2-41104 | * | 7/1988 |
| WO | WO 98/57560 | | 12/1998 |

* cited by examiner

ARTICLE OF FOOTWEAR INCORPORATING AN INFLATABLE CHAMBER

BACKGROUND OF THE INVENTION

1. Field of the Invention

The present invention relates to footwear. The invention concerns, more particularly, an article of footwear incorporating a fluid system that inflates a chamber within the fluid system and limits pressure of a fluid within the chamber.

2. Description of Background Art

Conventional articles of athletic footwear include two primary elements, an upper and a sole structure. The upper is usually formed of leather, synthetic materials, or a combination thereof and comfortably secures the footwear to the foot, while providing ventilation and protection from the elements. The sole structure often incorporates multiple layers that are conventionally referred to as an insole, a midsole, and an outsole. The insole is a thin, cushioning member located within the upper and adjacent the sole of the foot to enhance footwear comfort. The midsole is traditionally attached to the upper along the entire length of the upper and forms the middle layer of the sole structure. The outsole forms the ground-contacting element of footwear and is usually fashioned from a durable, wear resistant material that includes texturing to improve traction.

The primary material forming a conventional midsole is a resilient, polymer foam, such as polyurethane or ethylvinylacetate, that extends throughout the length of the footwear. A polymer foam midsole may also incorporate a fluid-filled chamber, having the configuration of a bladder, to enhance ground reaction force attenuation and energy absorption characteristics of the sole structure. U.S. Pat. No. 4,183,156 to Rudy provides an example of a fluid-filled chamber that includes an outer enclosing member formed of an elastomeric material. The outer enclosing material defines a plurality of tubular members in fluid communication with each other.

The fluid-filled chamber described above may be manufactured by a two-film technique, wherein two separate layers of elastomeric film are formed to have the overall shape of the chamber. The layers are then welded together along their respective peripheries to form an upper surface, a lower surface, and sidewalls of the chamber, and the layers are welded together at predetermined interior locations to impart a desired configuration to the chamber. That is, interior portions of the layers are connected to form sub-chambers of a predetermined shape and size at desired locations. The chamber is subsequently pressurized above ambient pressure by inserting a nozzle or needle, which is connected to a fluid pressure source, into a fill inlet formed in the chamber. After the chamber is pressurized, the nozzle is removed and the fill inlet is sealed, by welding for example.

Another method of manufacturing a fluid-filled chamber is through a blow-molding process, as generally disclosed in U.S. Pat. No. 5,353,459 to Potter et al., wherein a liquefied elastomeric material is placed in a mold having the desired overall shape and configuration of the bladder. The mold has an opening at one location through which pressurized air is provided. The pressurized air forces the liquefied elastomeric material against the inner surfaces of the mold and causes the material to harden in the mold, thereby forming a chamber with the desired shape and configuration. In addition, fluid-filled chambers may be manufactured through a thermoforming process, as disclosed in U.S. Pat. No. 5,976,451 to Skaja, et al., wherein a pair of sheets of flexible thermoplastic resin are placed against a pair of molds having a vacuum system for properly shaping the two sheets. The mold portions are then closed to seal the two sheets around their peripheries and form the bladder.

An article of footwear may also incorporate a fluid system that includes various components, including a pressure chamber, a pump chamber for increasing the pressure in the pressure chamber, one or more valves for regulating the direction and rate of fluid flow, and conduits that connect the various fluid system components. U.S. Pat. No. 6,457,262 to Swigart discloses a fluid system having a central chamber and two side chambers positioned medially and laterally of the central chamber. Each of the side chambers are in fluid communication with the central chamber through at least one conduit that includes a valve. Accordingly, a fluid contained by the fluid system may flow from the central chamber to side chambers, and the fluid may flow from the side chambers to the central chamber. Examples of other fluid systems that are sealed to prevent the entry or exit of ambient air are disclosed in U.S. Pat. No. 5,950,332 to Lain; U.S. Pat. No. 5,794,361 to Sadler; and U.S. Pat. No. 4,446,634 to Johnson et al., for example.

Fluid systems incorporated into an article of footwear may also utilize ambient air as the system fluid. U.S. Pat. No. 5,826,349 to Goss discloses an article of footwear having a fluid system that utilizes ambient air to ventilate an interior of an upper. The fluid system includes an intake positioned on the upper and a conduit leading from the intake to a plurality of chambers that are in fluid communication. Valves associated with the chambers prevent the air from escaping through the intake when the chambers are compressed. Rather, the air is forced out of the chambers through another conduit that leads to the interior of the upper. U.S. Pat. No. 5,937,462 to Huang disclose a fluid system that utilizes ambient air to pressurize a chamber within a sole structure of an article of footwear.

SUMMARY OF THE INVENTION

The present invention is a fluid system for an article of footwear. The fluid system includes a pump chamber, a pressure chamber, a fluid path, and a valve. The pressure chamber extends around at least a portion of the pump chamber, and the fluid path extends between the pump chamber and the pressure chamber to place the pump chamber and the pressure chamber in fluid communication. The valve is positioned within the fluid path to permit fluid flow from the pump chamber to the pressure chamber and to limit fluid flow from the pressure chamber to the pump chamber.

The pressure chamber may have a curved configuration that defines an interior area within the curved configuration, and the pump chamber may be positioned within the interior area. The pressure chamber may also be substantially located at an elevation of the pump chamber. Upon compression of the pump chamber, the fluid within the pump chamber enters the fluid path, passes through the valve, and passes into the pressure chamber, thereby adding more fluid to the pressure chamber and increasing the pressure of the fluid within the pressure chamber.

Following transfer of the fluid to the pressure chamber, the fluid within the pump chamber is replenished through additional fluid paths and valves that may be incorporated into the fluid system to provide access to a fluid source or ambient air, for example. In addition, a filter assembly may be incorporated into the fluid system to limit particulates and water from entering the fluid system. The fluid system may be formed from two coextensive sheets of polymer material that are bonded together to form the first chamber, the second chamber, and the fluid path, with valve being positioned between the sheets of polymer material.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose fluid systems in accordance with the present invention that are suitable for footwear applications. Concepts related to the fluid systems are disclosed with reference to an article of athletic footwear having a configuration intended for the sport of running. The fluid systems are not solely limited to footwear designed specifically for the sport of running, however, and may be incorporated into a wide range of athletic footwear styles, including basketball shoes, cross-training shoes, walking shoes, tennis shoes, soccer shoes, and hiking boots, for example. In addition, the fluid systems may be incorporated into non-athletic footwear styles, including dress shoes, loafers, sandals, and work boots. Accordingly, an individual skilled in the relevant art will appreciate that the concepts disclosed herein with regard to the fluid systems apply to a wide variety of footwear styles, in addition to the specific style discussed in the following material and depicted in the accompanying figures.

Figure 1:
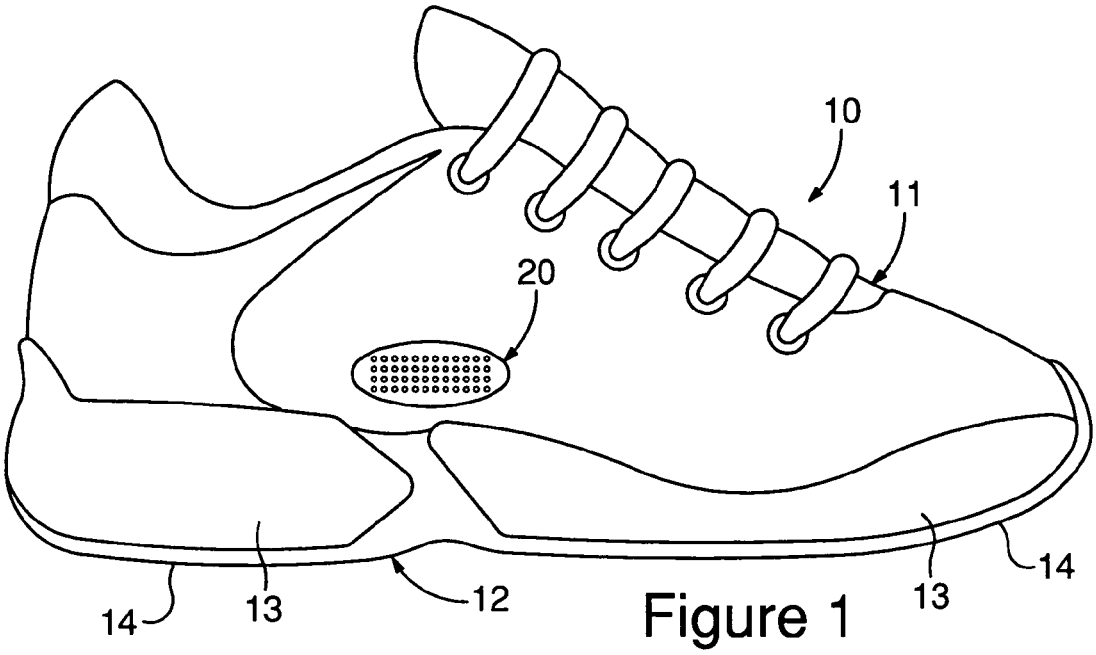
FIG. 1 is a lateral side elevational view of an article of footwear incorporating an exemplar fluid system in accordance with the present invention.

An article of footwear 10 is depicted in FIG. 1 and includes an upper 11 and a sole structure 12. Upper 11 has a substantially conventional configuration formed of a plurality elements, such as textiles, foam, and leather materials, that are stitched or adhesively bonded together to form an interior void for securely and comfortably receiving the foot. Sole structure 12 is positioned below upper 11 and includes two primary elements, a midsole 13 and an outsole 14. Midsole 13 is secured to a lower surface of upper 11, through stitching or adhesive bonding, for example, and operates to attenuate ground reaction forces and absorb energy as sole structure 12 contacts the ground. That is, midsole 13 is structured to provide the foot with cushioning during walking or running, for example. Outsole 14 is secured to a lower surface of midsole 13 and is formed of a durable, wear-resistant material that engages the ground. In addition, sole structure 12 may include an insole (not depicted), which is a thin cushioning member located within the void within upper 11 and adjacent to the foot to enhance the comfort of article of footwear 10.

Figure 2:
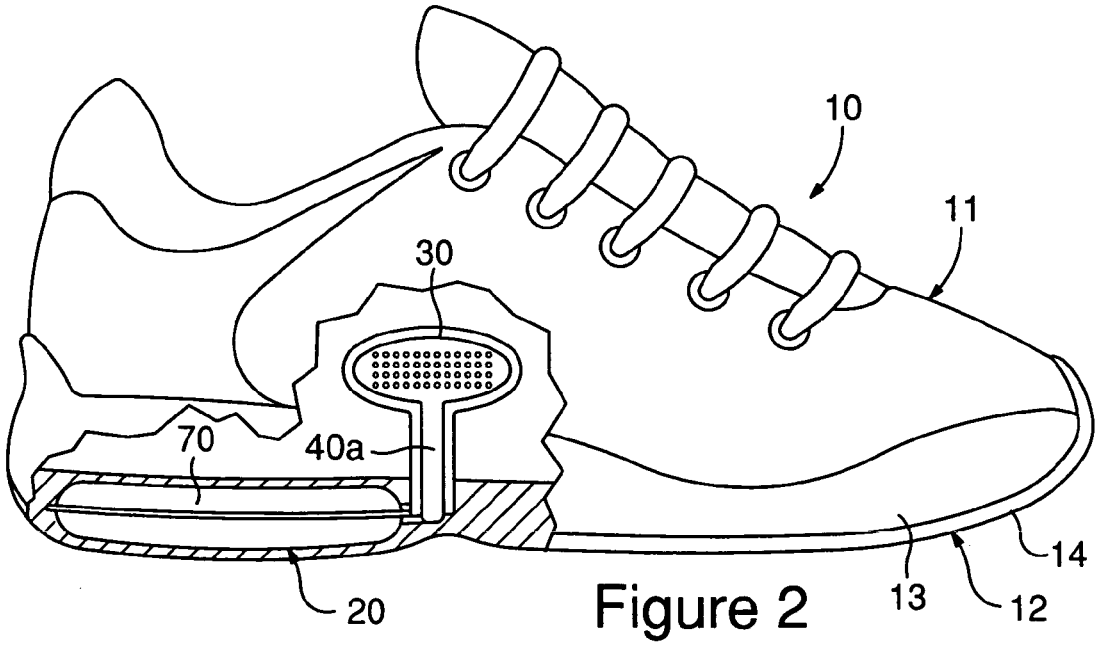
FIG. 2 is a partial cut-away view of the footwear depicting the fluid system.

Midsole 13 is primarily formed of a polymer foam material, such as polyurethane or ethylvinylacetate, that at least partially encapsulates a fluid system 20. As depicted in FIG. 2, fluid system 20 is positioned in a heel region of midsole 13, which corresponds with the area of highest initial force during footstrike. Fluid system 20 may, however, be positioned in any region of midsole 13 to impart a desired degree of cushioning response, stability, or other midsole properties. Furthermore, midsole 13 may incorporate multiple fluid systems 20, with a first fluid system 20 being positioned in the heel region and a second fluid system 20 being positioned in a forefoot region of midsole 13, for example. Fluid system 20 may also have a configuration that extends from the heel region to the forefoot region of midsole 13, thereby extending through a substantial portion of midsole 13.

Fluid system 20 is depicted individually in FIGS. 3–7 and provides a structure that utilizes ambient air to impart additional force attenuation and energy absorption as sole structure 12 contacts the ground. That is, fluid system 20 provides cushioning to supplement the cushioning provided by the polymer foam material of midsole 13. In addition, fluid system 20 may provide stability, improve the responsiveness, and enhance the ride characteristics of midsole 13. The primary elements of fluid system 20 are a filter assembly 30, a pair of conduits 40*a* and 40*b*, a pair of valves 50*a* and 50*b* that are positioned within conduits 40*a* and 40*b*, respectively, a pump chamber 60, and a pressure chamber 70. In operation, a fluid, such as ambient air, is drawn into conduit 40*a* by passing through filter assembly 30. The fluid then passes through valve 50*a* and into pump chamber 60. As pump chamber 60 is compressed, the fluid enters conduit 40*b* and passes through valve 50*b* to enter pressure chamber 70. A combination of the fluid within pump chamber 60 and pressure chamber 70 imparts the cushioning that is provided by fluid system 20. In some embodiments, however, a majority of the cushioning provided by fluid system 20 is imparted by pressure chamber 70.

A pair of polymer layers 21 and 22 are bonded together at specific bonding locations 23 to define conduits 40*a* and 40*b*, pump chamber 60, and pressure chamber 70 within fluid system 20. That is, conduits 40*a* and 40*b*, pump chamber 60, and pressure chamber 70 are formed at unbonded positions of polymer layers 21 and 22. The position of conduit 40*a* with respect to polymer layers 21 and 22 is selected to provide a fluid path that extends between a fluid source, such as ambient air, and pump chamber 60, thereby permitting the fluid to flow from filter assembly 30 to pump chamber 60. Similarly, the position of conduit 40*b* is selected to provide a fluid path that extends between pump chamber 60 and pressure chamber 70, which permits the fluid to also flow from pump chamber 60 to pressure chamber 70. In this configuration, therefore, the fluid may flow between polymer layers 21 and 22 to pass through conduits 40*a* and 40*b*.

Figure 3:
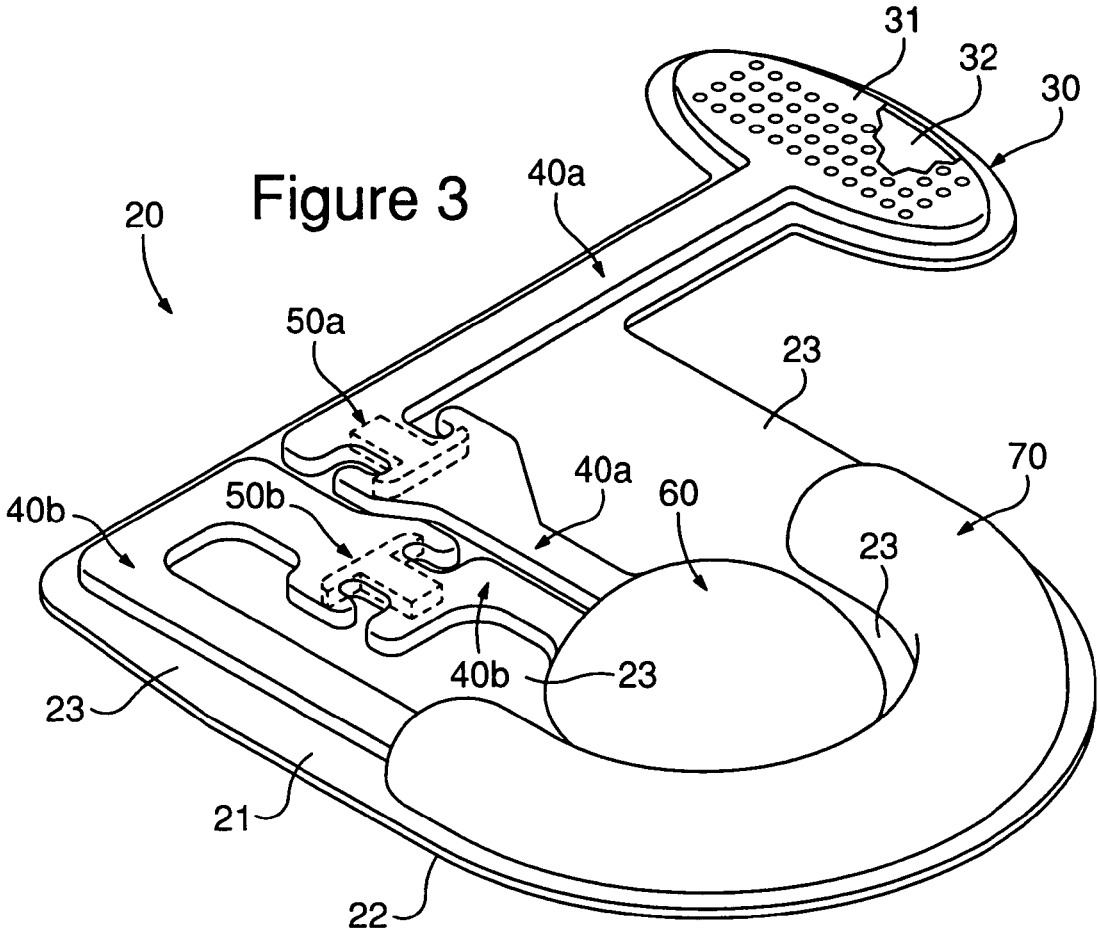
FIG. 3 is a perspective view of the fluid system.
Figure 4:
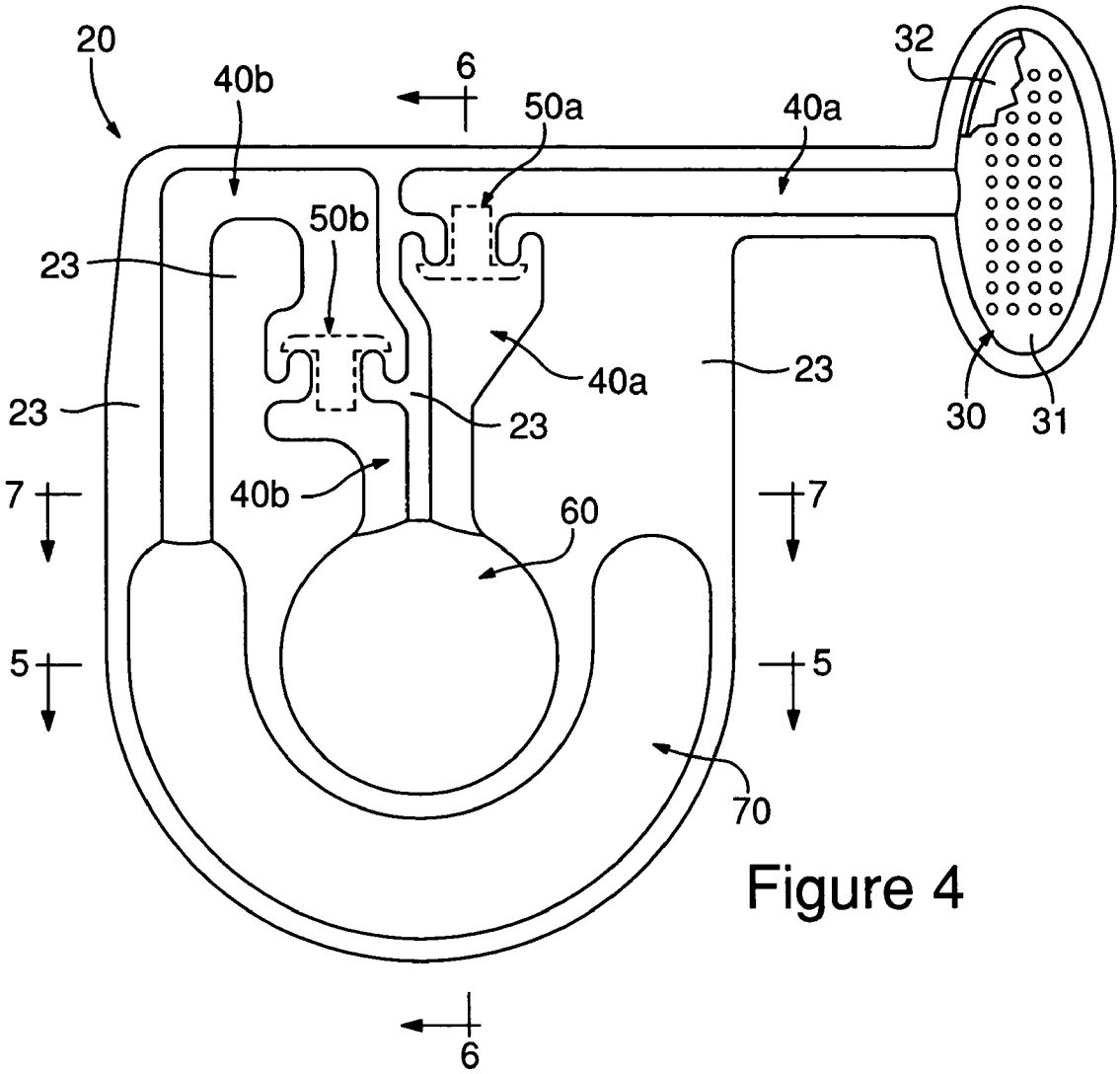
FIG. 4 is a top plan view of the fluid system.
Figure 5:
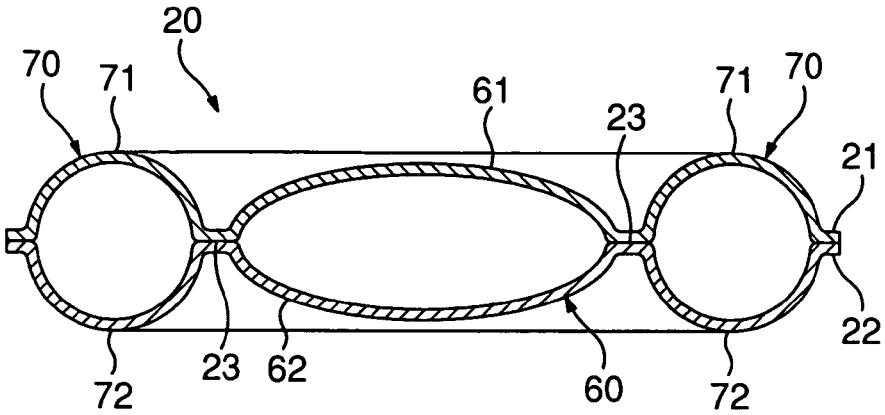
FIG. 5 is a first cross-sectional view, as defined along line 5—5 in FIG. 4.
Figure 6:
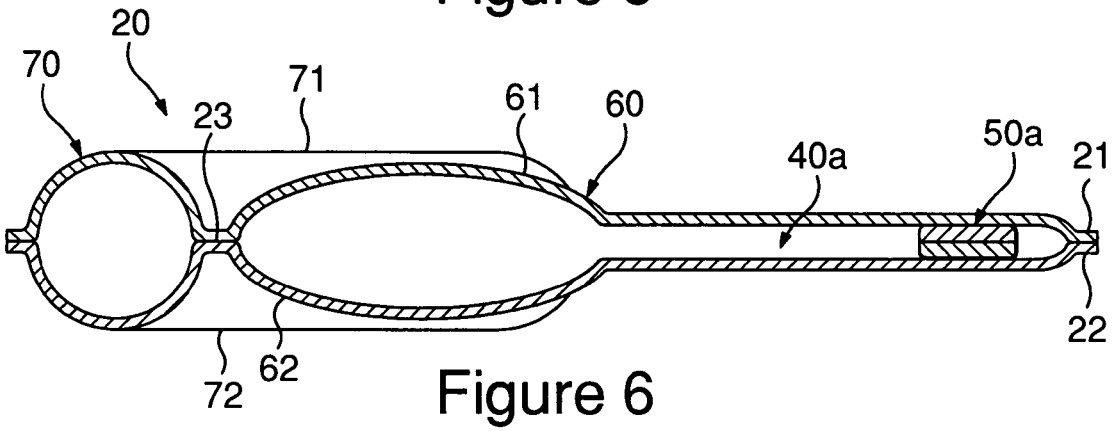
FIG. 6 is a second cross-sectional view, as defined along line 6—6 in FIG. 4.
Figure 7:
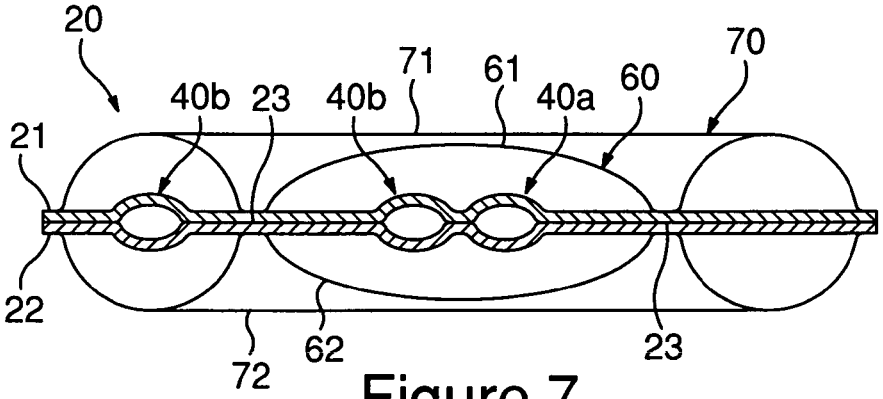
FIG. 7 is a third cross-sectional view, as defined along line 7—7 in FIG. 4.
Figure 8A:
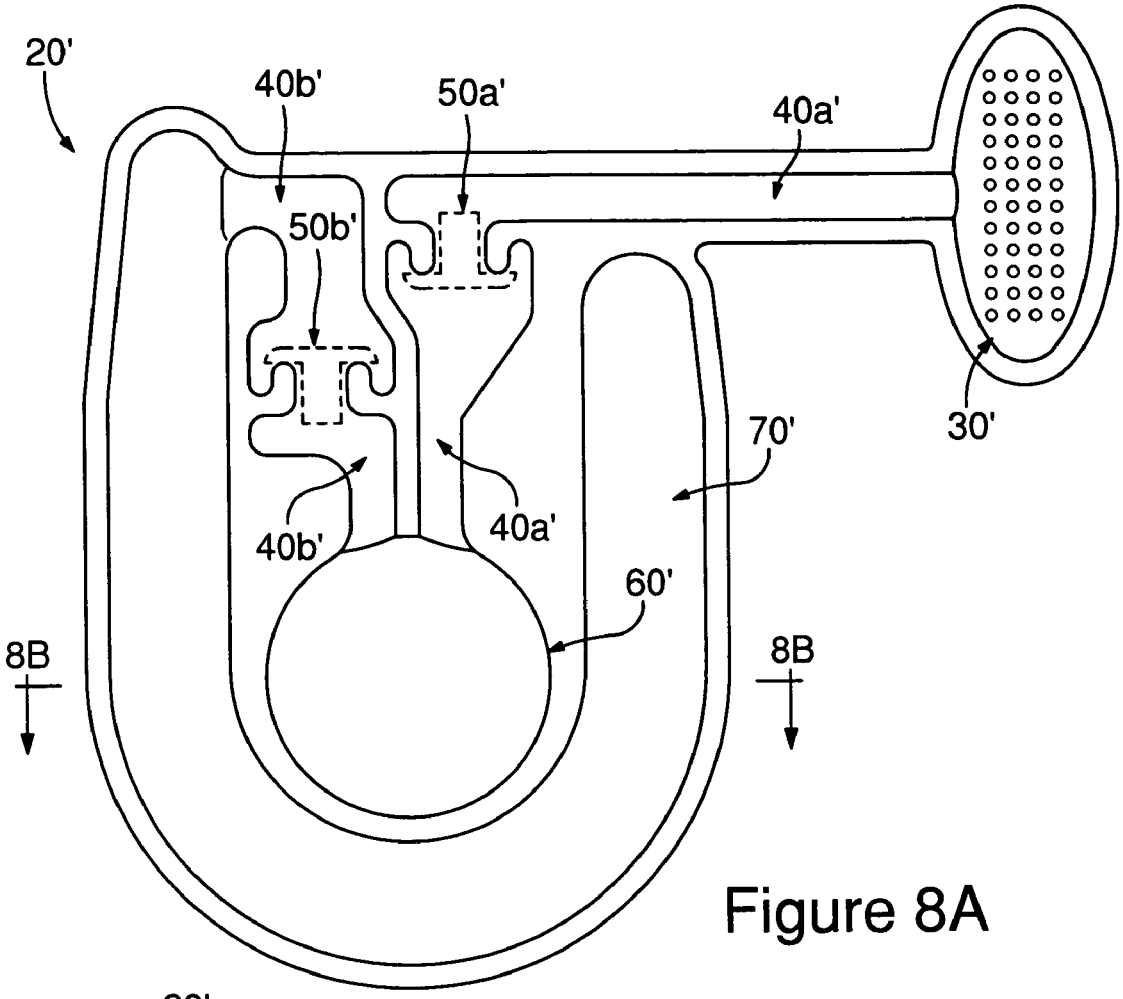
FIG. 8A is a top plan view of another exemplar fluid system in accordance with the present invention.
Figure 9A:
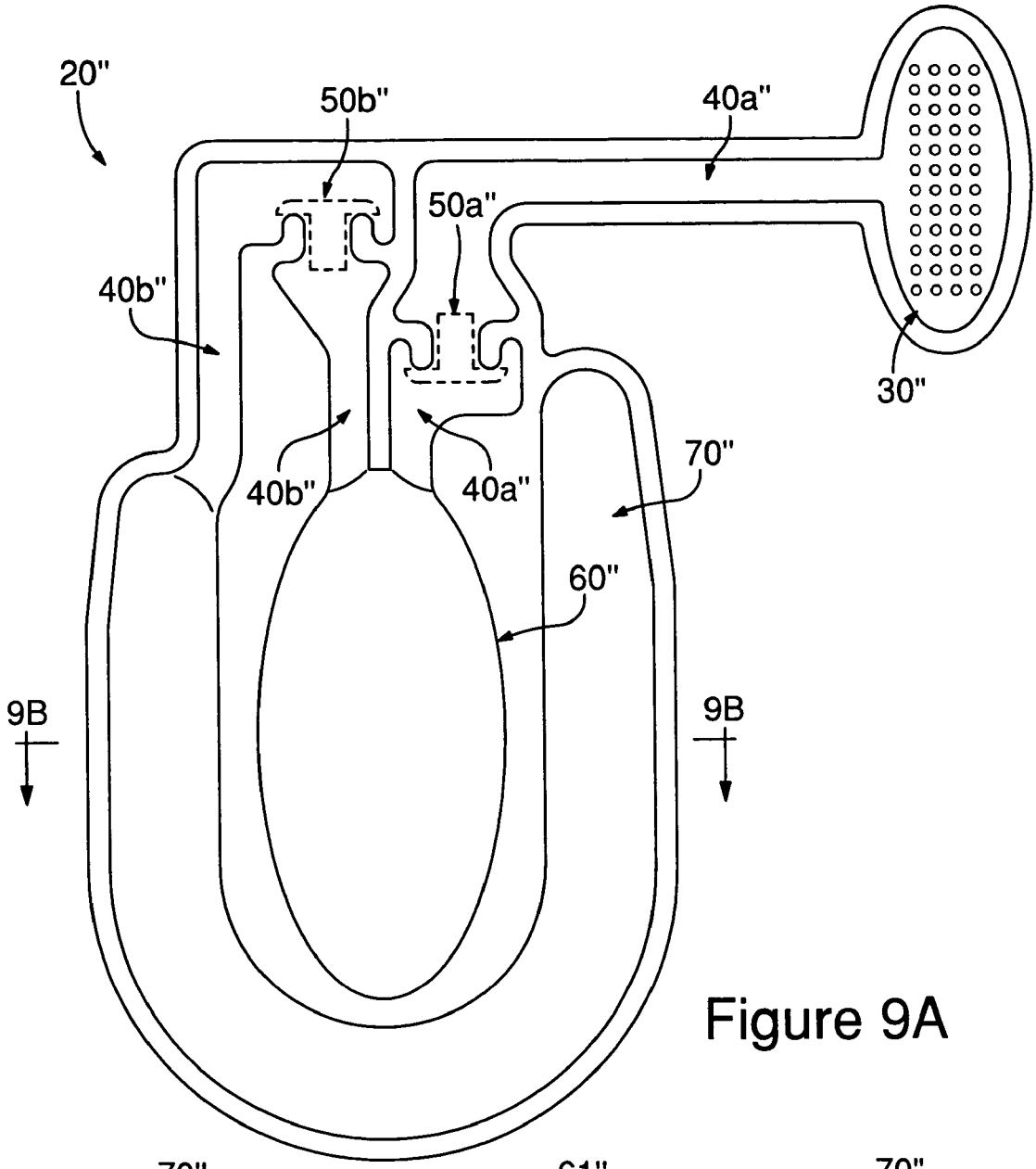
FIG. 9A is a top plan view of yet another exemplar fluid system in accordance with the present invention.

The position of pressure chamber 70 is also selected such that a portion of pressure chamber 70 extends at least partially around a side portion of pump chamber 60. The degree to which pressure chamber 70 extends around the side portion of pump chamber 60 is a design consideration that may be determined in accordance with the specific application in which fluid system 20 is being used. As will be discussed in the following material, the degree to which pressure chamber 70 extends around the side portion of pump chamber 60 contributes to a pressure-limiting feature of fluid system 20. In the various embodiments of fluid system 20, pressure chamber 70 may extend entirely around the side portion of pump chamber 60, or pressure chamber 70 may be configured to extend only partially around the side portion of pump chamber 60. As depicted in FIGS. 3 and 4, for example, pressure chamber 70 forms a generally C-shaped structure with an interior area that accommodates pump chamber 60. Accordingly, pressure chamber 70 extends around a substantial portion of pump chamber 60. In other embodiments of fluid system 20, however, pressure chamber 70 may extend only partially around the side portion of pump chamber 60. As depicted in the figures, however, pressure chamber 70 forms a curved structure with an interior area for positioning pump chamber 60. End portions of pressure chamber 70 may also be extended to form a U-shaped structure with an interior area for also receiving portions of conduits 40*a* and 40*b*, as depicted in FIGS. 8A and 9A.

A variety of materials are suitable for polymer layers 21 and 22, including barrier materials that are substantially impermeable to the fluid within fluid system 20. Such barrier materials may include, for example, alternating layers of thermoplastic polyurethane and ethylene-vinyl alcohol copolymer, as disclosed in U.S. Pat. Nos. 5,713,141 and 5,952,065 to Mitchell et al. A variation upon this material wherein the center layer is formed of ethylene-vinyl alcohol copolymer, the two layers adjacent to the center layer are formed of thermoplastic polyurethane, and the outer layers are formed of a regrind material of thermoplastic polyurethane and ethylene-vinyl alcohol copolymer may also be utilized. Another suitable material is a flexible microlayer material that includes alternating layers of a gas barrier material and an elastomeric material, as disclosed in U.S. Pat. Nos. 6,082,025 and 6,127,026 to Bonk et al.

Although polymer layers 21 and 22 may be formed of the barrier materials discussed above, more economical thermoplastic elastomer materials that are at least partially impermeable to the fluid within fluid system 20 may also be utilized. As discussed above, fluid system 20 operates to draw fluid, such as air, into pump chamber 60 and pressure chamber 70 in order to provide cushioning to article of footwear 10. If a portion of the fluid within pump chamber 60 or pressure chamber 70 should escape from fluid system 20 by passing through polymer layers 21 and 22, then fluid system 20 will operate to draw additional fluid into pump chamber 60 and pressure chamber 70, thereby replenishing the escaped fluid. Accordingly, polymer layers 21 and 22 need not provide a barrier that is substantially impermeable to the fluid within fluid system 20, but may be at least partially impermeable to the fluid within fluid system 20. Suitable polymer materials include, therefore, thermoplastic elastomers such as polyurethane, polyester, polyester polyurethane, and polyether polyurethane. In addition to decreased manufacturing costs, a benefit of utilizing these thermoplastic elastomers is that the specific material forming polymer layers 21 and 22 may be selected based primarily upon the engineering properties of the material, rather than the barrier properties of the material. Accordingly, the material forming polymer layers 21 and 22 may be selected to exhibit a specific tensile strength, elastic modulus, durability, degree of light transmission, elasticity, resistance to corrosion or chemical breakdown, or abrasion resistance, for example.

Filter assembly 30 has the general structure of a filter assembly described in U.S. patent application Ser. No. 09/887,523, which was filed Jun. 21, 2001 and is hereby entirely incorporated by reference. Filter assembly 30 is generally positioned on an exterior of article of footwear 10 and includes two primary components, a cover element 31 and a filter material 32. Cover element 31 extends over filter material 32 and includes a plurality of perforations that permit air to access filter material 32, while preventing relatively large objects, such as stones and tree branches, from directly contacting and potentially damaging filter material 32. The fluid is drawn into fluid system 20 through filter material 32, which limits water, other liquids, and a variety of particulates from hindering the operation of various system components, such as valves 50*a* and 50*b* and pressure chamber 70. If permitted to enter fluid system 30, particulates, for example, could collect around and within valves 50*a* and 50*b*. As will be discussed in greater detail below, valves 50*a* and 50*b* are one-directional valves that permit fluid to flow in a first direction, but limit or check fluid flow in an opposite second direction. Particulates that collect around and within valves 50*a* and 50*b* may affect the one-directional operation of valves 50*a* and 50*b*, thereby permitting the fluid to flow through fluid system 20 in an unintended manner. In the absence of filter assembly 30, water and particulates could also collect within pressure chamber 70. In some embodiments of the present invention, a portion of pressure chamber 70 may be visible through apertures formed in the polymer foam material of midsole 13. Particulates that collect within pressure chamber 70 could become visible from the exterior of article of footwear 10, thereby decreasing the aesthetic properties of article of footwear 10. If water were also permitted to enter and collect in pump chamber 60, pressure chamber 70, or other portions of fluid system 20, the weight of article of footwear 10 may increase significantly. Furthermore, particulates may act as an abrasive that wears away portions of fluid system 20, thereby decreasing durability. Accordingly, filter assembly 30 acts to limit the entry of liquids and particulates that may have a detrimental effect upon fluid system 20.

One suitable material for filter material 32 is polytetrafluoroethylene (PTFE), which may be deposited on a substrate material. PTFE exhibits the required characteristics and is suitably durable when attached to a substrate such as non-woven polyester. A variation upon the standard formulation of PTFE is expanded polytetrafluoroethylene (ePTFE) which is manufactured by, for example, W.L. Gore & Associates. In addition to PTFE, other suitable materials for filter material 32 include high density polyethylene, ultrahigh molecular weight polyethylene, polyvinylidene fluoride, polypropylene, and certain ceramic filter materials. Knit materials, woven materials, nonwoven materials, laminate structures consisting of one or more differing filter materials, and paper may also be suitable. In addition, filter material 32 may be formed of a solid, porous material.

Valves 50*a* and 50*b* may be any type of valve that performs in accordance with the design requirements of system 20. Valves structures that may be utilized for valves 50*a* and 50*b* include, for example, duckbill valves manufactured by Vernay Laboratories, Inc. and the two-layer polymer valves disclosed in U.S. Pat. No. 5,144,708 to Pekar and U.S. Pat. No. 5,564,143 to Pekar et al. Both types of valves are generally considered one-directional valves that permit fluid flow in a first direction, but limit fluid flow in an opposite second direction. With respect to fluid system 20, valve 50*a* permits fluid flow in the direction from filter assembly 30 to pump chamber 60, and valve 50*b* permits fluid flow in the direction from pump chamber 60 to pressure chamber 70. Valves 50*a* and 50*b*, however limit fluid flow in opposite directions. Depending upon the specific characteristics that a fluid system is intended to impart, valves that permit fluid flow in both directions may also be utilized within the scope of the present invention. In addition to the valve structures disclosed above, valves 50*a* and 50*b* may also have the configuration of a valve 100, which is described with reference to FIGS. 10A–10G following a more detailed discussion regarding the operation of fluid system 20.

Fluid system 20 is configured to provide an air inlet that is separate from pump chamber 60. With reference to FIGS. 3 and 4, fluid system 20 is depicted as having an air inlet at filter assembly 30, and conduit 40*a* extends between filter assembly 30 and pump chamber 60. Accordingly, air is introduced into fluid system 20 through an air inlet that is separate from pump chamber 60. The separate air inlet and pump chamber 60 permits the air inlet to be located on any portion of footwear 10, including upper 11, and this configuration permits the air inlet to include a filter material 32 that is not positioned in an area of repetitive compressive forces.

Another feature of fluid system 20 is the direct fluid communication between pump chamber 60 and pressure chamber 70. Conduit 40*b* leads directly from pump chamber 60 to pressure chamber 70 and provides an area for positioning valve 50*b*. Accordingly, a minimum number of fluid system components are placed in the fluid path between pump chamber 60 and pressure chamber 70. This configuration reduces the pressure losses that arise through transfer of the fluid from pump chamber 60 to pressure chamber 70. Furthermore, this configuration provides a fluid system with a relatively small number of components.

The operation of fluid system 20 will now be discussed in detail. The pressure of the fluid within the various components of fluid system 20 changes depending upon the manner in which article of footwear 10 is utilized, the frequency at which sole structure 12 is compressed, and the force that compresses sole structure 12, for example. For purposes of the present discussion, the operation of fluid system 20, and the pressure of the fluid within the various components of fluid system 20 will be discussed with regard to an initial state, a transition state, and an equilibrium state. During the initial state, pump chamber 60 and pressure chamber 70 contain a fluid with an initial pressure that is substantially equal to the ambient pressure of air that surrounds article of footwear 10 and fluid system 20. During the transition state, the pressure within pressure chamber 70 increases from the initial pressure to an equilibrium pressure, at which time fluid system 20 is in the equilibrium state.

Fluid system 20 is at least partially encapsulated within the polymer foam material of midsole 13. In manufacturing article of footwear 10, fluid system 20 is positioned within a mold having the shape of midsole 13. When fluid system 20 is placed within the mold, fluid system 20 is either in the initial state or the pressure of the fluid within pump chamber 60 and pressure chamber 70 is slightly elevated above the ambient pressure. Accordingly, pump chamber 60 and pressure chamber 70 are in an expanded configuration rather than a collapsed configuration. That is, the fluid places sufficient outward pressure upon polymer layers 21 and 22 to prevent pump chamber 60 and pressure chamber 70 from significantly collapsing. The polymer foam material of midsole 13 is then injected into the mold and around fluid system 20. Upon curing of the polymer foam material, fluid system 20 is securely encapsulated within midsole 13 such that pump chamber 60 and pressure chamber 70 remain in the expanded configuration. Furthermore, the polymer foam material may bond to the exterior surfaces of polymer layers 21 and 22. Midsole 13 is then secured to upper 11 and outsole 14 to form article of footwear 10.

During the manufacturing process of article of footwear 10, the pressure of the fluid within pump chamber 60 and pressure chamber 70 may be slightly elevated above the ambient pressure, as discussed above. As article of footwear 10 is shipped to retailers or stored, the fluid within fluid system 20 may diffuse through polymer layers 21 and 22 or otherwise escape from fluid system 20 until the pressure of the fluid is substantially equal to the ambient pressure of air that surrounds article of footwear 10 and fluid system 20. Accordingly, when an individual first places article of footwear 10 upon the foot, fluid system 20 is in the initial state.

Fluid system 20 may be positioned in the heel region of midsole 13, as depicted in FIGS. 1 and 2. More particularly, fluid system 20 may be positioned such that pump chamber 60 is positioned directly below the calcaneus bone of the individual wearing article of footwear 10, and pressure chamber 70 is positioned below side portions of the calcaneus bone. When the individual takes a first step in article of footwear 10, sole structure 12 is compressed against the ground, which compresses both midsole 13 and fluid system 20. Based upon the relative positions of the calcaneus bone, pump chamber 60, and pressure chamber 70, pump chamber 60 bears a large portion of the force that causes the compression, and pressure chamber 70 also bears a portion of the force. The compression of pump chamber 60 causes the pressure of the fluid within pump chamber 60 to increase. When a pressure differential between pump chamber 60 and pressure chamber 70 exceeds various pressure losses inherent in fluid system 20, a portion of the fluid within pump chamber 60 passes through conduit 40*b* and through valve 50*b* to pass into pressure chamber 70. That is, compressing pump chamber 60 may cause a portion of the fluid within pump chamber 60 to pass into pressure chamber 70. The additional fluid within pressure chamber 70 causes the pressure within pressure chamber 70 to increase. As the individual takes a first step, therefore, fluid system 20 is placed in the transition state due to increases in pressure of both pump chamber 60 and pressure chamber 70. The various pressure losses mentioned above may be associated with friction that occurs as the fluid passes through conduit 40*b* and an opening pressure of valve 50*b*.

Valves 50*a* and 50*b* are one-directional valves that permit fluid flow in a first direction, but limit or check fluid flow in an opposite second direction. Valve 50*a* permits fluid to flow from filter assembly 30 to pump chamber 60, but limits fluid flow in the opposite direction. When pump chamber 60 is compressed, therefore, valve 50*a* effectively prevents the fluid from flowing to filter assembly 30. Valve 50*b*, however, permits fluid to flow from pump chamber 60 to pressure chamber 70 when the pressure differential between pump chamber 60 and pressure chamber 70 exceeds the opening pressure of valve 50*b*.

As the first step that the individual takes progresses, and the calcaneus bone no longer places a significant force upon midsole 13, the compressive force exerted upon fluid system 20 decreases and midsole 13 returns to an uncompressed configuration. The pressure of the fluid within pressure chamber 70, however, remains elevated and fluid system 20 remains in the transition state. Due to the bonds between the polymer material of midsole 13 and polymer layers 21 and 22, midsole 13 will place an outward force on pump chamber 60 as midsole 13 returns to the uncompressed configuration. That is, the polymer material of midsole 13 will attempt to expand the compressed pump chamber 60. This action causes the pressure within pump chamber 60 to become negative relative to the ambient pressure of the air outside of article of footwear 10 and fluid system 20. Accordingly, a negative pressure differential is formed between pump chamber 60 and the ambient air. Filter assembly 30 and conduit 40*a* form a fluid path between the ambient air and pump chamber 60. When the negative pressure differential exceeds various pressure losses associated with fluid system 20, ambient air will pass through filter assembly 30, enter conduit 40*a*, pass through valve 50*a*, and enter pump chamber 60, thereby placing additional fluid within pump chamber 60. In other words, air will flow into pump chamber 60 as midsole 13 expands from being compressed. The various pressure losses mentioned above may be associated with resistance from filter material 32, friction that occurs as the fluid passes through conduit 40*a*, and an opening pressure of valve 50*a*.

The discussion above details the manner in which a first step of the individual compresses pump chamber 60 and causes a portion of the fluid within pump chamber 60 to pass into pressure chamber 70, thereby increasing the pressure within pressure chamber 70. Once the first step is completed and midsole 13 is not being compressed, additional air passes into pump chamber 60 from the ambient air that surrounds article of footwear 10 and fluid system 20. When the individual takes a second step and a plurality of further steps, the process described with respect to the first step repeats and the pressure of the fluid within pressure chamber 70 increases. Accordingly, fluid system 20 remains in the transition stage as the pressure within pressure chamber 70 rises.

Immediately prior to the first step, the pressure within pump chamber 60 and pressure chamber 70 was substantially equal to the ambient pressure of air. As midsole 13 was compressed, therefore, pump chamber 60 and pressure chamber 70 provided a relatively small degree of support. That is, the pressure of the fluid within pump chamber 60 and pressure chamber 70 was not sufficient to provide a relatively large degree of cushioning. As the individual continues to take steps and the pressure of the fluid within pressure chamber 70 increases, however, the degree of support and cushioning provided by pressure chamber 70 also increases. After a sufficient number of steps, the support provided by pressure chamber 70 prevents pump chamber 60 from being compressed significantly. In other words, the support provided by pressure chamber 70 will limit the degree to which pump chamber 60 is compressed when midsole 13 is compressed. Accordingly, the pressure of the fluid within pressure chamber 70 will eventually balance the compression of pump chamber 60, and fluid system 20 will reach the equilibrium state.

The pressure of the fluid within pressure chamber 70 at the equilibrium state is at least partially a function of the degree to which pressure chamber 70 extends around the side portion of pump chamber 60. For purposes of example, assume pump chamber 60 and pressure chamber 70 are sufficiently separated such that increases in pressure within pressure chamber 70 do not provide support against compressions of pump chamber 60. In this configuration, the maximum pressure of pressure chamber 70 is approximately equal to the maximum pressure that the individual may induce within pump chamber 60. When pressure chamber 70 extends around at least a portion of the side portion of pump chamber 60, however, the increase in pressure of the fluid within pressure chamber 70 provides support against compressing pump chamber 60. As the degree to which pressure chamber 70 extends around pump chamber 60 increases, the amount of support that pressure chamber 70 may provide to resist compressions of pump chamber 60 also increases. For example, if pressure chamber 70 extends only partially around the side portion of pump chamber 60, then portions of pump chamber 60 that are not adjacent to pressure chamber 70 may remain compressible. If, however, pressure chamber 70 extends entirely around pump chamber 60, then pressure chamber 70 may substantially limit the amount of pump chamber 60 that may be compressed. Accordingly, the pressure of the fluid within pressure chamber 70 is at least partially determined by the degree to which pressure chamber 70 extends around the side portion of pump chamber 60. The pressure of the fluid within pressure chamber 70 is, therefore, effectively limited by extending pressure chamber 70 around at least a portion of pump chamber 60. Other factors that determine the pressure of the fluid within pressure chamber 70 include the relative forces exerted upon pump chamber 60 and pressure chamber 70, the relative dimensions of pump chamber 60 and pressure chamber 70, and the compressibility of the foam material encapsulating fluid system 20, for example.

Figure 8B:
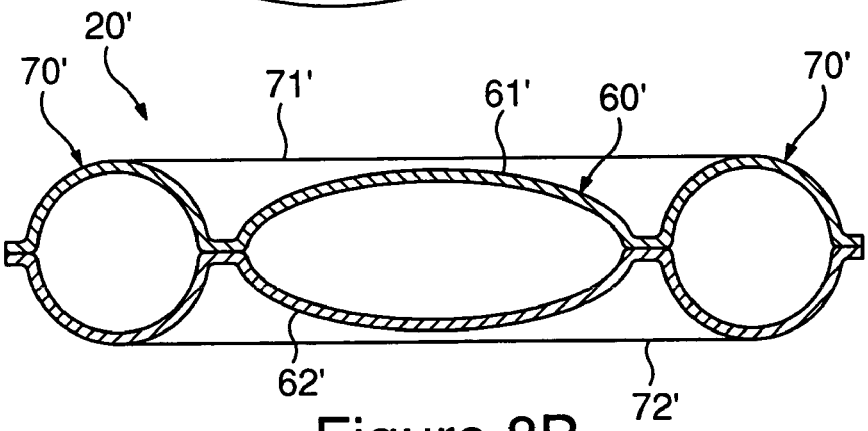
FIG. 8B is a cross-sectional view, as defined along line 8B—8B in FIG. 8A.

Pressure chamber 70, as depicted in FIGS. 3 and 4, forms a generally C-shaped structure with an interior area that accommodates pump chamber 60. In other embodiments of fluid system 20, however, pressure chamber 70 may extend around the side portion of pump chamber 60 to a lesser or greater degree. With reference to FIGS. 8A and 8B, an alternative embodiment of the present invention is depicted, wherein a fluid system 20' includes a filter assembly 30', a pair of conduits 40*a*' and 40*b*', a pair of valves 50*a*' and 50*b*', a pump chamber 60', and a pressure chamber 70'. Fluid system 20' has the general configuration of fluid system 20, but end portions of pressure chamber 70' are elongated to form a generally U-shaped structure that forms an interior area for receiving pressure chamber 70' and portions of conduits 40*a*' and 40*b*'. Whereas pressure chamber 70 will substantially limit compression of pump chamber 60 when the pressure of the fluid within pressure chamber 70 is relatively high, the extended end portions of pressure chamber 70' may limit compression of pump chamber 60' to a greater degree. In addition, the extended end portions of pressure chamber 70' may limit the compression of other components of fluid system 20', including conduits 40*a*' and 40*b*40 and valves 50*a*' and 50*b*', thereby extending the life of the components.

Figure 9B:
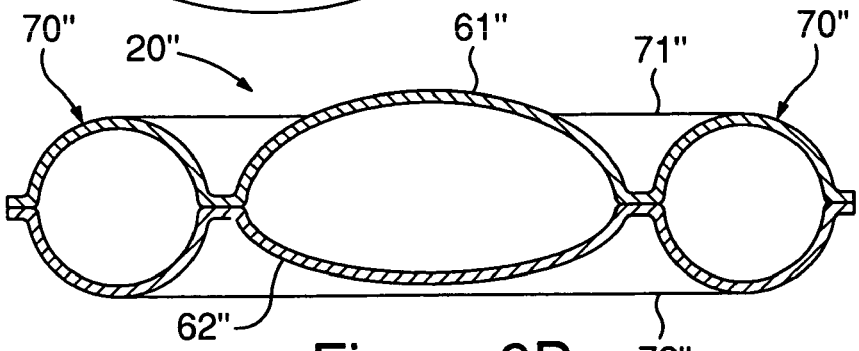
FIG. 9B is a cross-sectional view, as defined along line 9B—9B in FIG. 9A.
Figure 10A:
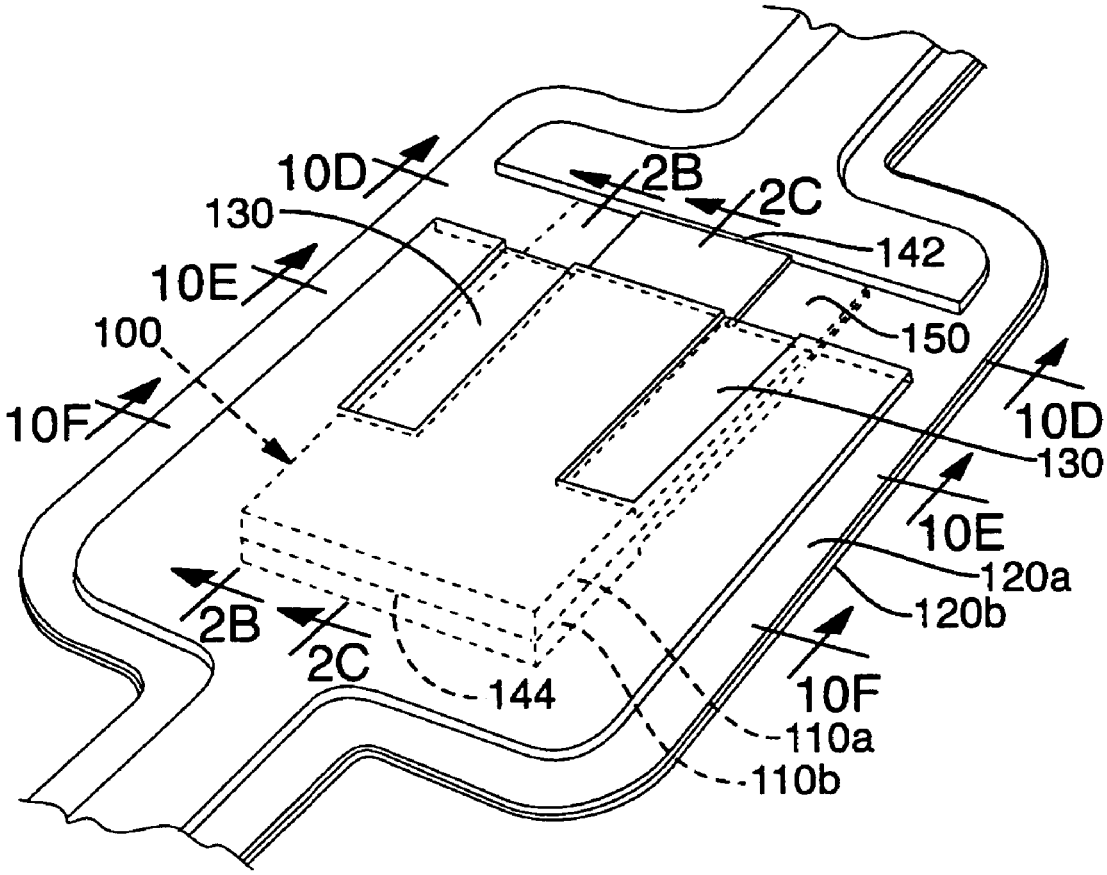
FIG. 10A is a perspective view of a valve suitable for use in the fluid system.
Figure 10B:
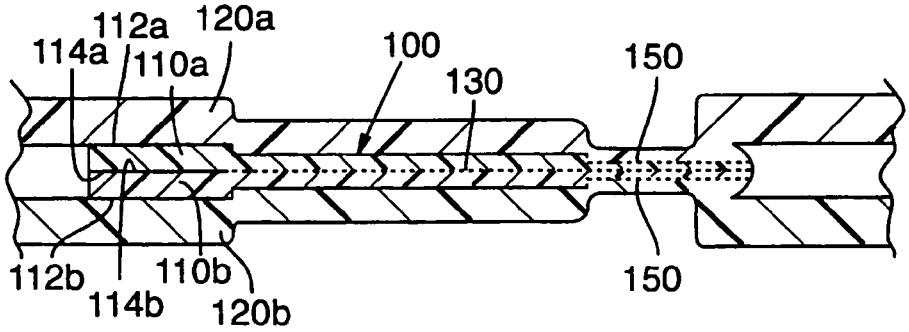
FIG. 10B is a first cross-sectional view of the valve, as defined by line 10B—10B in FIG. 10A.
Figure 10C:
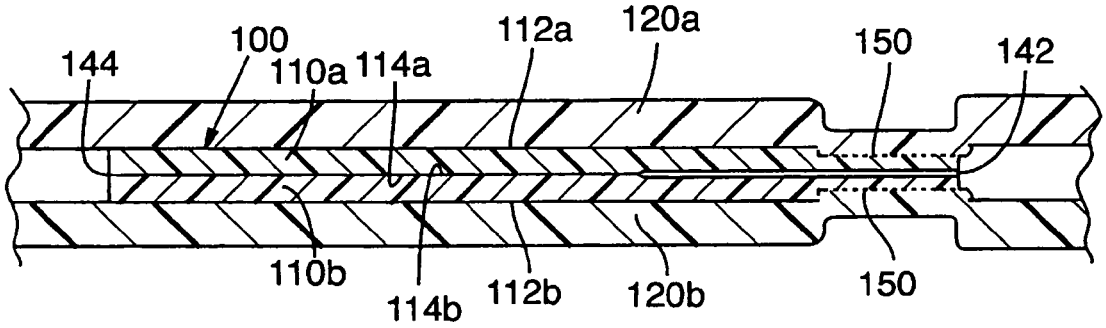
FIG. 10C is a second cross-sectional view of the valve, as defined by line 10C—10C in FIG. 10A.
Figure 10D:
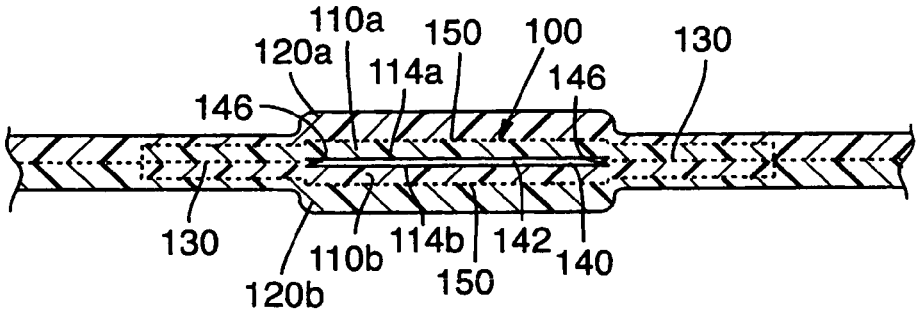
FIG. 10D is a third cross-sectional view of the valve, as defined by line 10D—10D in FIG. 10A.
Figure 10E:
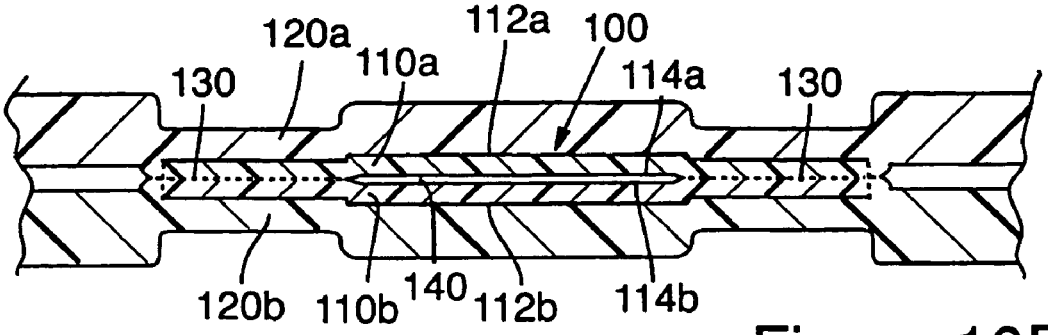
FIG. 10E is a fourth cross-sectional view of the valve, as defined by line 10E—10E in FIG. 10A.
Figure 10F:
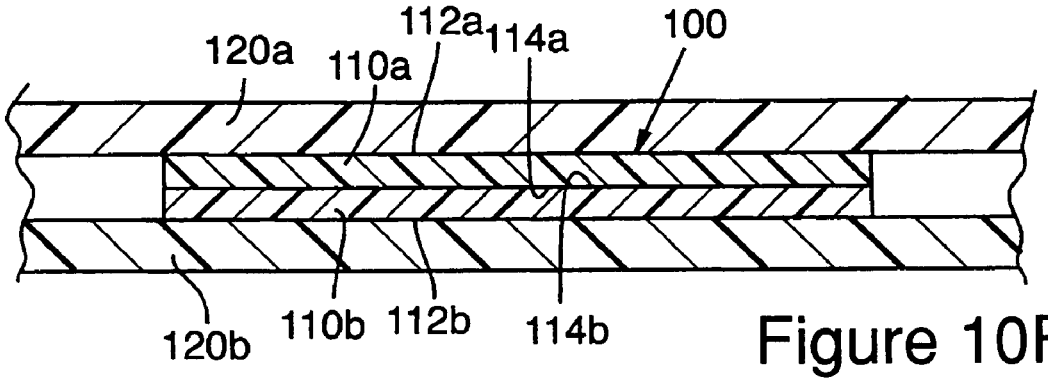
FIG. 10F is a fifth cross-sectional view of the valve, as defined by line 10F—10F in FIG. 10A.
Figure 10G:
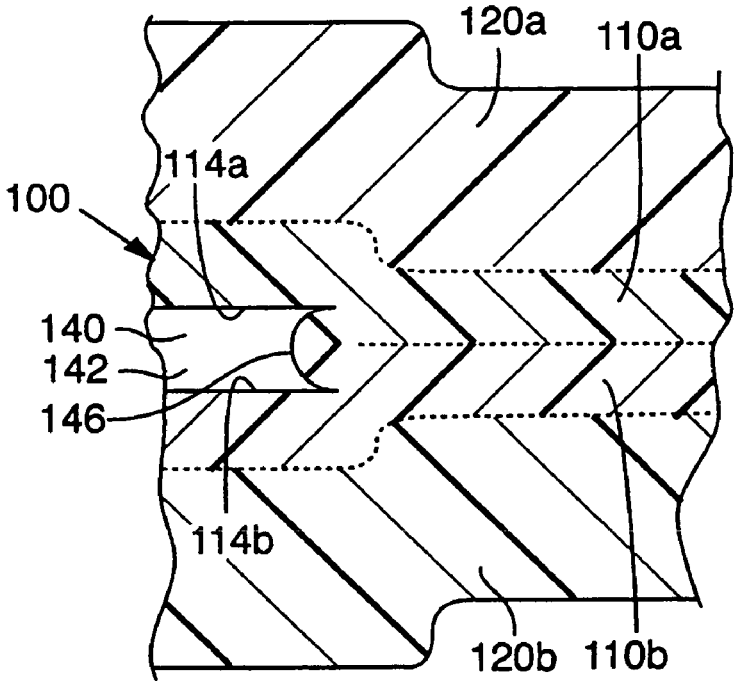
FIG. 10G is an enlarged view of a weld bead depicted in FIG. 10D.

Pump chamber 60, as depicted in FIGS. 3 and 4, has a substantially circular configuration. With respect to FIGS. 9A and 9B, another embodiment of the present invention is depicted, wherein a fluid system 20" includes a filter assembly 30", a pair of conduits 40*a*41 and 40*b*", a pair of valves 50a" and 50*b*", a pump chamber 60", and a pressure chamber 70". In contrast with the substantially circular configuration of pump chamber 60, pump chamber 60" has an elongate configuration. Pressure chamber 70" also has a U-shaped configuration that forms an interior area for receiving pump chamber 60" and limiting compression of pump chamber 60".

Pump chamber 60 is generally positioned such that a top portion 61 of pump chamber 60 does not extend above a top portion 71 of pressure chamber 70. Similarly, a bottom portion 62 of pump chamber 60 does not extend below a bottom portion 72 of pressure chamber 70. Fluid system 20' has a similar configuration, wherein a top portion 61' of pump chamber 60' does not extend above a top portion 71' of pressure chamber 70', and a bottom portion 62' of pump chamber 60' does not extend below a bottom portion 72' of pressure chamber 70'. In contrast with fluid systems 20 and 20', a top portion 61" of pump chamber 60" extends above a top portion 71" of pressure chamber 70", as depicted in the cross-sectional view of FIG. 9B. A bottom portion 62" of pump chamber 60" is not depicted, however, as extending below a bottom portion 72" of pressure chamber 70". The relative vertical positions of pump chamber 60" and pressure chamber 70" have an effect upon the pressure limiting property of fluid system 20". Even when pressure chamber 70" is at a maximum pressure, the volume of pump chamber 60" extending above top portion 71" of pressure chamber 70" may be compressed. Pressure chamber 70" does, however, limit the compressibility of the portion of pump chamber 60" located at or below top portion 71" of pressure chamber 70". Accordingly, the relative vertical positions of pump chambers and pressure chambers may also be utilized to affect the pressure limiting property of a fluid system.

Fluid system 20 may be formed through a thermoforming process that involves heating layers 21 and 22 and utilizing a mold to bond layers 21 and 22 together in the desired locations. Prior to heating layers 21 and 22, valves 50*a* and 50*b* may be placed between portions of layers 21 and 22 that will become conduits 40*a* and 40*b*. Similarly, filter material 32 may be placed between portions of layers 21 and 22 that will become filter assembly 30. The mold utilized in the thermoforming process may have areas that compress layers 21 and 22 to form bonded areas 23 that define conduits 40*a* and 40*b*, pump chamber 60, and pressure chamber 70. Furthermore, the mold may have cavities configured to receive portions of layers 21 and 22 and define the shapes of conduits 40*a* and 40*b*, pump chamber 60, and pressure chamber 70. When bonding layers 21 and 22 together, a fluid may be injected between layers 21 and 22 to press layers 21 and 22 into the various contours of the mold. Similarly, a vacuum may be induced on the exterior of layers 21 and 22 to also draw layers 21 and 22 into the various contours of the mold. Fluid systems 20' and 20" may also be formed through a similar thermoforming process.

A variety of other processes may be utilized to form fluid system 20, in addition to the thermoforming process described above. For example, layers 21 and 22 may be formed from flat thermoplastic sheets that are bonded together to define conduits 40*a* and 40*b*, pump chamber 60, and pressure chamber 70. In addition, layers 21 and 22 may be separately formed to include indentations corresponding with conduits 40*a* and 40*b*, pump chamber 60, and pressure chamber 70. Valves 50*a* and 50*b* may then be placed between layers 21 and 22, and bonds may be formed to join layers 21 and 22. Furthermore, fluid system 20 or individual components of fluid system 20 may be manufactured through blow molding or rotational molding processes. In situations where individual components of fluid system 20 are formed separately, the individual components may be joined together to form fluid system 20. That is, a bonding technique may be utilized to join conduits 40*a* and 40*b*, pump chamber 60, and pressure chamber 70, as described in U.S. patent application Ser. No. 10/351,876, which was filed Jan. 27, 2003 and is hereby entirely incorporated by reference.

The structure of valve 100 will now be discussed in greater detail. Valve 100 has the general structure of one of a plurality of valves described in U.S. patent application Ser. No. 10/246,755, which was filed Sep. 19, 2002 and is hereby entirely incorporated by reference. A valve having the structure of valve 100 may be utilized as either or both of valves 50*a* and 50*b* to regulate the fluid flow within fluid system 20. Valve 100 may also be utilized as valves 50*a*', 50*b*', 50*a*", or 50*b*" to regulate the fluid flow within fluid systems 20' and 20". Valve 100 is depicted in FIGS. 10A–10G and includes a first valve layer 110*a* and a second valve layer 110*b* that are positioned between a first substrate layer 120*a* and a second substrate layer 120*b*. With respect to fluid system 20, for example, substrate layers 120 are analogous to polymer layers 21 and 22 that form conduits 40*a* and 40*b*. First valve layer 110*a* and second valve layer 110*b* are bonded together along opposite sides to form two channel welds 130 and define a channel 140 positioned between valve layers 110 and between channel welds 130. Channel 140 includes an inlet 142 and an outlet 144. Inlet 142 is biased in the open position by two inlet weld beads 146 formed of polymer material that collects in inlet 142 and adjacent to channel welds 130 during the bonding of first valve layer 110*a* and second valve layer 110*b*. Outlet 144 is located opposite inlet 142 and may be formed of unbonded portions of valve layers 110. Each valve layer 110 includes an outer surface 112 and an opposite inner surface 114. With regard to valve layer 110*a*, an outer surface 112*a* lies adjacent to substrate layer 120*a* and an inner surface 114*a* that lies adjacent to valve layer 110*b*. Similarly, valve layer 110*b* includes an outer surface 112*b* that lies adjacent to substrate layer 120*b* and an opposite inner surface 114*b* that lies adjacent to valve layer 110*a*.

Valve 100 also includes two substrate welds 150 that attach valve layers 110 to substrate layers 120. More specifically, substrate welds 150 attach valve layer 110*a* to substrate layer 120*a* and attach valve layer 110*b* to substrate layer 120*b*. As depicted in FIG. 10, substrate welds 150 are located adjacent to inlet 142. Substrate welds 150 may also be positioned adjacent to other portions of valve 100.

In operation, valve 100 permits fluid flow through channel 140 and in the direction from inlet 142 to outlet 144. Valve 100, however, significantly limits fluid flow in the opposite direction. As noted, inlet weld beads 146 bias inlet 142 in the open position. This configuration ensures that the fluid in conduit 30 may enter at least the portion of channel 140 formed by inlet 142. The primary factor that determines whether the fluid may pass through valve 100 is the relative difference in pressure between the fluid in inlet 142 and the fluid at outlet 144. When the pressure of the fluid in inlet 142 exceeds the pressure of the fluid at outlet 144 plus an opening pressure of valve 100, the force that the fluid in inlet 142 exerts on inner surfaces 114 of valve layers 110 is sufficient to overcome the force that the fluid at outlet 144 exerts on outer surfaces 112, thereby permitting valve layers 110 to separate. When valve layers 110 separate, fluid may pass through channel 140. When the pressure of the fluid in inlet 142 is less than the pressure of the fluid at outlet 144, however, the force that the fluid in inlet 142 exerts on inner surfaces 114 of valve layers 110 is not sufficient to overcome the force that the fluid at outlet 142 exerts on outer surfaces 112, thereby preventing valve layers 110 from separating. When valve layers 110 are not separated, channel 140 is effectively closed to fluid transfer.

Outlet 144 assists in preventing the passage of fluid through valve 100 by ensuring that valve layers 110 make a hermetic contact. Note that channel welds 130 may extend less than the entire length of valve layers 110. Accordingly, outlet 144 may include unbonded portions of valve layers 110. The lack of bonds at outlet 144 permits unobstructed closure at outlet 144, thereby providing the hermetic contact between valve layers 110 that prevents fluid from passing between valve layers 110. Inner surfaces 114 may include a smooth, cohesive surface that facilitates closure of valve 100. Accordingly, the characteristics of inner surfaces 114 may also contribute to the hermetic contact and facilitate one-directional fluid flow through valve 100.

The materials forming valve layers 110 and substrate layers 120 should possess several characteristics. First, the materials should permit welds 130 and 150 to securely form between the various material layers using standard techniques, such as thermal contact, RF energy, laser, and infrared welding. Second, the materials should also be substantially impermeable to fluids, such as air. Third, the materials should possess sufficient flexibility to permit valve 100 to operate as described above. Fourth, the materials should be possess a durability that permits valve 100 to operate through numerous cycles. Fifth, the materials may be chosen to resist hydrolysis, or chemical breakdown due to the presence of water, if water or water vapor may be present around valve 100. Based upon these considerations, suitable materials include thermoplastic polyurethane, urethane, polyvinyl chloride, and polyethylene. When valve 100 is formed of thermoplastic polyurethane, a suitable thickness for valve layers 110 is 0.018 inches, but may range from 0.004 inches to 0.035 inches, for example. Similarly, a suitable thickness for substrate layers 120 is 0.030 inches, but may range from 0.015 inches to 0.050 inches, for example. The thickness of valve layers 110 and the thickness of substrate layers 120 may depart from the ranges listed above, however, depending upon the specific application for valve 100, the materials and manufacturing methods utilized, and the properties that valve 100 is intended to impart to the fluid system.

A benefit to locating substrate welds 150 adjacent to inlet 142 lies in the relatively large area of outer surfaces 112 that are exposed to the fluid at outlet 144. As noted above, when the pressure of the fluid in inlet 142 is less than the pressure of the fluid at outlet 144, the force that the fluid in inlet 142 exerts on inner surface 114 of valve layers 110 is not sufficient to overcome the force that the fluid at outlet 144 exerts on outer surfaces 112, thereby preventing valve layers 110 from separating and preventing the flow of fluid through valve 100. By configuring the position of valve layers 110 such that a relatively large area of outer surfaces 112 are exposed to the fluid at outlet 144, the area of contact between inner surfaces 114 increases proportionally. The primary mechanism that prevents fluid from passing through valve 100 is the hermetic contact properties of inner surfaces 114. Accordingly, increased efficiency is achieved by having a relatively large portion of outer surfaces 112 exposed to the fluid at outlet 144.

As an alternative, valve 100 may be formed from a single valve layer 110 that is bonded with one of the substrate layers 120 to form channel welds 130. Accordingly, channel 140 may be formed between channel welds 130 and between the valve layer 110 and the substrate layer 120. The alternative valve 100 operates in a manner that is substantially similar to the operation of valve 100. In addition, valve 100 may be formed such that channel welds 130 extend around and enclose outlet 144. An aperture may then be formed in one of valve layers 110 to permit the fluid to pass through valve 100. In either alternative embodiment, contact between valve layer 110 and the substrate layer 120 effectively closes valve 100.

As discussed above, when the pressure of the fluid in inlet 142 is less than the pressure of the fluid at outlet 144, the force that the fluid in inlet 142 exerts on inner surfaces 114 of valve layers 110 is not sufficient to overcome the force that the fluid at outlet 142 exerts on outer surfaces 112, thereby preventing valve layers 110 from separating. When valve layers 110 are not separated, channel 140 is effectively closed to fluid transfer. If, however, particulates are positioned within valve 100 and between valve layers 110, the fluid may be able to pass through valve 100 in the direction of outlet 144 to inlet 142. That is, the effectiveness of valve 100 in preventing fluid transfer in the direction from outlet 144 to inlet 142 may be compromised by the presence of particulates 74.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A fluid system for an article of footwear, the fluid system comprising:

a pair of polymer sheets that define a pump chamber, a pressure chamber positioned adjacent to the pump chamber, and a fluid path extending from the pump chamber to the pressure chamber to place the pump chamber and the pressure chamber in one-directional fluid communication; and a bond that joins the polymer sheets and forms edges of both the pump chamber and the pressure chamber, the bond being located between areas of the polymer sheets that define the pump chamber and the pressure chamber, and the bond separating fluid in the pump chamber from fluid in the pressure chamber, the pump chamber and the pressure chamber being located on opposite sides of a portion of the bond.

2. The fluid system recited in claim 1, wherein the pressure chamber has a concave configuration and the pump chamber is at least partially positioned within an area formed by the concave configuration.

3. The fluid system recited in claim 1, wherein a portion of the bond has a curved configuration that defines a concavity in the pressure chamber, the pump chamber being at least partially positioned within an area formed by the concavity in the pressure chamber.

4. The fluid system recited in claim 1, wherein a top portion of the pressure chamber extends above the pump chamber.

5. The fluid system recited in claim 1, wherein a top portion of the pump chamber extends above the pressure chamber.

6. The fluid system recited in claim 1, wherein a valve is positioned between the polymer sheets and within the fluid path to permit fluid flow from the pump chamber to the pressure chamber and to substantially prevent fluid flow from the pressure chamber to the pump chamber.

7. The fluid system recited in claim 6, wherein the valve is formed from at least one layer of polymer material.

8. The fluid system recited in claim 7, wherein the valve includes an inlet that is biased open with at least one weld bead positioned within the inlet.

9. The fluid system recited in claim 1, wherein another fluid path with a filter assembly extends from an exterior of the fluid system to the pump chamber to place the pump chamber in fluid communication with the exterior of the footwear.

10. The fluid system recited in claim 9, wherein the filter assembly includes a filter material that permits air to enter to fluid system and restricts liquids and particulates from entering the fluid system.

11. The fluid system recited in claim 10, wherein the filter material includes a polytetrafluoroethylene material.

12. The fluid system recited in claim 1, wherein the fluid path consists of a conduit and a valve.

13. The fluid system recited in claim 1, wherein a fluid inlet for the fluid system is in fluid communication with the pump chamber, and the fluid inlet is separate from the pump chamber.

14. A fluid system for an article of footwear, the fluid system comprising:

a pair of polymer sheets that define a pump chamber, a pressure chamber positioned adjacent to the pump chamber, and a fluid path extending from the pump chamber to the pressure chamber to place the pump chamber and the pressure chamber in fluid communication;

a bond that joins the polymer sheets and forms edges of both to pump chamber and the pressure chamber, the bond being located between areas of the polymer sheets that define the pump chamber and the pressure chamber, and the bond separating fluid in the pump chamber from fluid in the pressure chamber; and a valve positioned between the polymer sheets and within the fluid path to permit fluid flow from the pump chamber to the pressure chamber and to substantially prevent fluid flow from the pressure chamber to to pump chamber, wherein the pump chamber and the pressure chamber are located on opposite sides of the bond and border the bond, and the bond has a curved configuration that defines a concavity in the pressure chamber, the pump chamber being at least partially positioned within an area formed by the concavity in the pressure chamber.

15. The fluid system recited in claim 14, wherein the valve is formed from at least one layer of polymer material.

16. The fluid system recited in claim 15, wherein the valve includes an inlet that is biased open with at least one weld bead positioned within the inlet.

17. The fluid system recited in claim 14, wherein another fluid path with a filter assembly extends from an exterior of the fluid system to the pump chamber to place the pump chamber in fluid communication with the exterior of the footwear.

18. The fluid system recited in claim 17, wherein the filter assembly includes a filter material that permits air to enter the fluid system and restricts liquids and particulates from entering the fluid system.

19. The fluid system recited in claim 18, wherein the filter material includes a polytetrafluoroethylene material.

20. The fluid system recited in claim 14, wherein the fluid path consists of a conduit and the valve.

21. The fluid system recited in claim 14, wherein a fluid inlet for the fluid system is in fluid communication with the pump chamber, and the fluid inlet is separate from the pump chamber.

22. A fluid system for an article of footwear, the fluid system comprising:

a first polymer sheet and a second polymer sheet, the first polymer sheet having a pump chamber area, a pressure chamber area, a bond area, and a fluid path area, an edge of the pump chamber area being parallel to an edge of the pressure chamber area, and at least a portion of the bond area being located between the edge of the pump chamber area and the edge of the pressure chamber area; and a bond that joins the bond area of the first polymer sheet to the second polymer sheet and defines (a) a pump chamber between the first polymer sheet and the second polymer sheet and in a location corresponding wit the pump chamber area, (b) a pressure chamber between the first polymer sheet and the second polymer sheet and in a location corresponding with the pressure chamber area, and (c) a one-directional fluid path between the first polymer sheet and the second polymer sheet and in a location corresponding with the fluid path area, the fluid path extending from the pump chamber to the pressure chamber to place the pump chamber and the pressure chamber in fluid communication, at least a portion of the bond being positioned between the edge of the pump chamber area and the edge of the pressure chamber area to separate fluid in the pump chamber from fluid in the pressure chamber.

23. The fluid system recited in claim 22, wherein the pressure chamber has a concave configuration and the pump chamber is at least partially positioned within an area formed by the concave configuration.

24. The fluid system recited in claim 22, wherein a top portion of the pressure chamber extends above the pump chamber.

25. The fluid system recited in claim 22, wherein a top portion of the pump chamber extends above the pressure chamber.

26. The fluid system recited in claim 22, wherein a valve is positioned between the polymer sheets and within the fluid path to permit fluid flow from the pump chamber to the pressure chamber and to substantially prevent fluid flow from the pressure chamber to the pump chamber.

27. The fluid system recited in claim 26, wherein the valve is formed from at least one layer of polymer material.

28. The fluid system recited in claim 27, wherein the valve includes an inlet that is biased open with at least one weld bead positioned within the inlet.

29. The fluid system recited in claim 22, wherein another fluid path with a filter assembly extends from an exterior of the fluid system to the pump chamber to place the pump chamber in fluid communication with the exterior of the footwear.

30. The fluid system recited in claim 29, wherein the filter assembly includes a filter material that permits air to enter the fluid system and restricts liquids and particulates from entering the fluid system.

31. The fluid system recited in claim 30, wherein the filter material includes a polytetrafluoroethylene material.

32. The fluid system recited in claim 22, wherein the fluid path consists of a conduit and a valve.

33. The fluid system recited in claim 22, wherein a fluid inlet for the fluid system is in fluid communication with the pump chamber, and the fluid inlet is separate from the pump chamber.

34. A fluid system for an article of footwear, the fluid system comprising:

a pair of polymer sheets that define a pump chamber, a pressure chamber positioned adjacent to the pump chamber, and a fluid path extending from the pump chamber to the pressure chamber to place the pump chamber and the pressure chamber in fluid communication; and a bond having a first edge and an opposite a second edge separated by an area where the polymer sheets are joined together, the first edge forming a border of the pump chamber, and the second edge forming a border of the pressure chamber, the bond separating fluid in the pump chamber from fluid in the pressure chamber, wherein the first edge and the second edge define an area located between the pump chamber and the pressure chamber, the fluid path being absent from the area located between the pump chamber and the pressure chamber.

35. The fluid system recited in claim 34, wherein the pressure chamber has a concave configuration and the pump chamber is at least partially positioned within an area formed by the concave configuration.

36. The fluid system recited in claim 34, wherein a valve is positioned between the polymer sheets and within the fluid path to permit fluid flow from the pump chamber to the pressure chamber and to substantially prevent fluid flow from the pressure chamber to the pump chamber.

37. The fluid system recited in claim 34, wherein the valve is formed from at least one layer of polymer material.

38. The fluid system recited in claim 37, wherein the valve includes an inlet that is biased open with at least one weld bead positioned within the inlet.

39. The fluid system recited in claim 34, wherein another fluid path with a filter assembly extends from an exterior of the fluid system to the pump chamber to place the pump chamber in fluid communication with the exterior of the footwear.

40. The fluid system recited in claim 39, wherein the filter assembly includes a filter material that permits air to enter the fluid system and restricts liquids and particulates from entering the fluid system.

41. The fluid system recited in claim 40, wherein the filter material includes a polytetrafluoroethylene material.

42. The fluid system recited in claim 34, wherein the fluid path consists of a conduit and a valve.

43. The fluid system recited in claim 34, wherein a fluid inlet for the fluid system is in fluid communication with the pump chamber, and the fluid inlet is separate from the pump chamber.

44. A fluid system for an article of footwear, the fluid system comprising:

a pair of polymer sheets that define a pump chamber, a pressure chamber, a first fluid path, and a second fluid path, the first fluid path extending from the pump chamber to the pressure chamber to place the pump chamber and the pressure chamber in fluid communication, and the second fluid path extending from an exterior of the fluid system to the pump chamber to place the pump chamber in fluid communication with the exterior of the fluid system;

a first valve positioned between the polymer sheets and within the first fluid path to permit fluid flow from the pump chamber to the pressure chamber and to limit fluid flow from the pressure chamber to the pump chamber;

a second valve positioned between the polymer sheets and within the second fluid path to permit fluid flow from the exterior of the fluid system to the pump chamber and to limit fluid flow from the pump chamber to the exterior; and a single bond that joins the polymer sheets and extends along a boundary of the pump chamber, the pressure chamber, the first fluid path, and the second fluid path, a portion of the bond being located between the pump chamber and the pressure chamber to separate fluid in the pump chamber from fluid in the pressure chamber, opposite sides of the portion of the bond being located immediately adjacent the pump chamber and the pressure chamber.

45. The fluid system recited in claim 44, wherein the pressure chamber has a concave configuration and the pump chamber is at least partially positioned within an area formed by the concave configuration.

46. The fluid system recited in claim 44, wherein the portion of the bond has a curved configuration that defines a concavity in the pressure chamber, the pump chamber being at least partially positioned within an area formed by the concavity in the pressure chamber.

47. The fluid system recited in claim 44, wherein the valve is formed from at least one layer of polymer material.

48. The fluid system recited in claim 47, wherein the valve includes an inlet that is biased open with at least one weld bead positioned within the inlet.

49. A fluid system for an article of footwear, the fluid system comprising:

a pair of polymer sheets that define a pump chamber, a pressure chamber separated from the pump chamber by a space that is located between the pump chamber and the pressure chamber, and a fluid path extending from the pump chamber to the pressure chamber to place the pump chamber and the pressure chamber in fluid communication, the fluid path being absent from the space; and a bond that joins the polymer sheets and forms edges of both the pump chamber and the pressure chamber, the bond being positioned in the space, and the bond separating fluid in the pump chamber from fluid in the pressure chamber.

50. The fluid system recited in claim 49, wherein the pressure chamber has a concave configuration and the pump chamber is at least partially positioned within an area formed by the concave configuration.

51. The fluid system recited in claim 49, wherein the portion of the bond has a curved configuration that defines a concavity in the pressure chamber, the pump chamber being at least partially positioned within an area formed by the concavity in the pressure chamber.

52. The fluid system recited in claim 49, wherein a valve is positioned between the polymer sheets and within the fluid path, the valve being formed from at least one layer of polymer material.

53. The fluid system recited in claim 52, wherein the valve includes an inlet that is biased open with at least one weld bead positioned within the inlet.

* * * * *